United States Patent [19]

Boyett

[11] Patent Number: 4,577,890

[45] Date of Patent: Mar. 25, 1986

[54] REMOVABLE BOOK MARKER STRIP

[76] Inventor: Gladys D. Boyett, 1418 Argyle Dr., Fort Myers, Fla. 33907

[21] Appl. No.: 591,119

[22] Filed: Mar. 19, 1984

[51] Int. Cl.[4] ..... B42D 3/00; B42D 3/12; B42D 3/04; B42C 11/00

[52] U.S. Cl. ..... 281/29; 281/19 R; 281/34; 412/4

[58] Field of Search ..... 281/17, 19 R, 29, 34; 412/4

[56] References Cited

U.S. PATENT DOCUMENTS

| | | | |
|---|---|---|---|
| 1,354,354 | 9/1920 | Toland | 281/34 |
| 2,560,087 | 7/1951 | Cohn | 281/34 |
| 3,297,341 | 1/1967 | Reed et al. | 281/34 |
| 3,933,375 | 1/1976 | Humphrey | 281/34 |
| 3,981,522 | 9/1976 | Bloom | 281/34 |
| 4,209,187 | 6/1980 | Forest | 281/19 R |
| 4,341,401 | 7/1982 | Arntzen | 412/4 |
| 4,412,692 | 11/1983 | Williams | 281/34 |

*Primary Examiner*—Paul A. Bell
*Assistant Examiner*—Paul M. Heyrana
*Attorney, Agent, or Firm*—Alfred E. Wilson

[57] ABSTRACT

In the higher priced grade of books, which for example are known generally as the "hard copies" as distinguished from the more economically priced so-called "paper backs", it is customary to protect the books by a so-called dust shield or protective book cover. These protective covers are generally highly colored and carry a pictorial image of the author, or of some primary incident in the story. When it is necessary to put down the book without finishing reading it in one sitting, it is desirable to have a book marker so that one's place can be quickly and easily found so that the story can be continued without regression. Frequently a portion of a page of newspaper or magazine is torn off to provide a small book marker. By the present invention a narrow perforated edge of the fold under flap of the book cover may be torn off from the dust shield or cover and used as a book marker to mark one's place in the book. As frequently happens, two parties in a family may be alternately reading the same book simultaneously. To accommodate this contingency the marginal edges on both sides of the dust shields can have narrow perforated sections which can be torn off to provide two book markers. Opposite sides of the dust shield can conveniently be colored differently so that it is possible to readily distinguish one's book marker from the other. Similarly, the outer edges of so-called paper backs can be turned in and perforated to render readily accessible book markers available.

5 Claims, 4 Drawing Figures

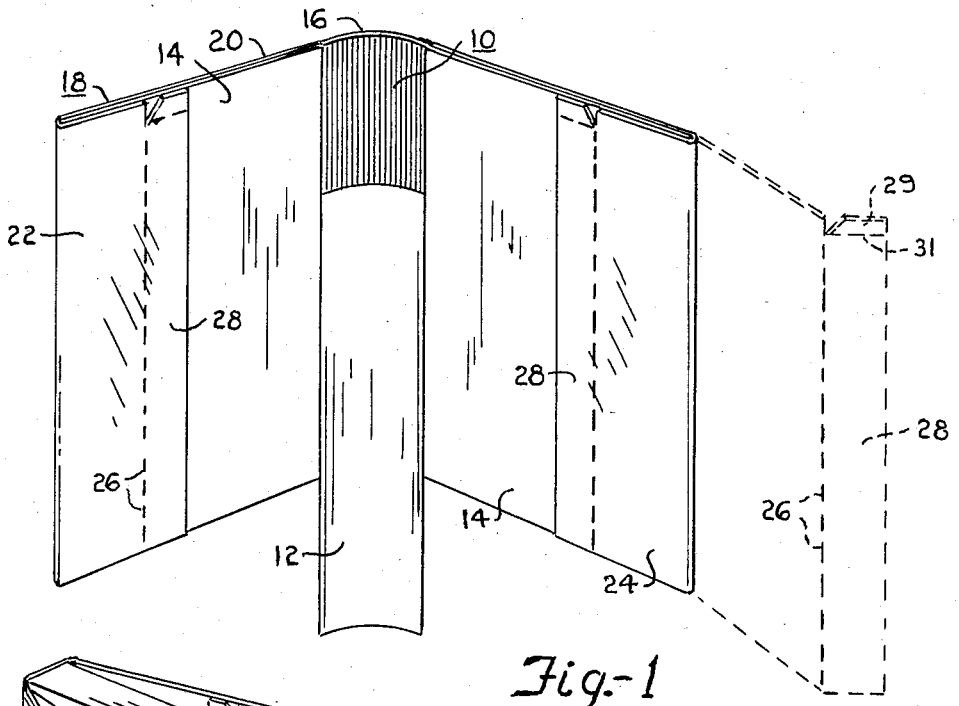
Fig.-1
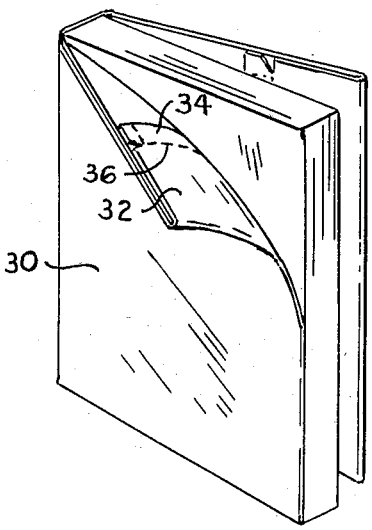
Fig.-2
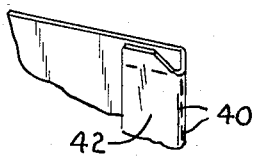
Fig.-3
Fig.-4
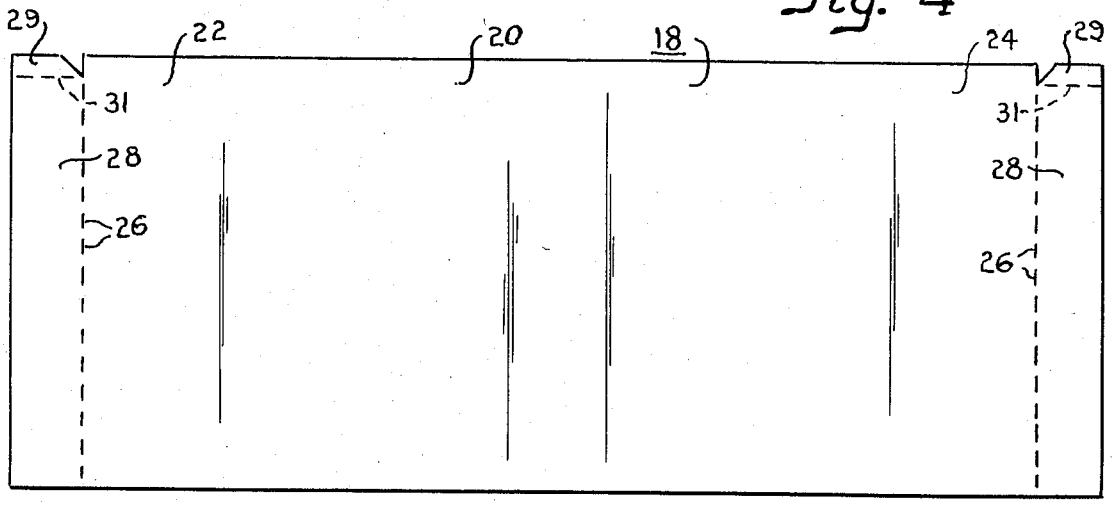

REMOVABLE BOOK MARKER STRIP

BACKGROUND OF THE INVENTION

1. Field of the Invention

The present invention relates to a dust shield or protective cover for a book of the so-called "hard cover" type wherein in addition to the function of acting as a dust shield to protect the book, the dust shield has a perforated, readily removable stip at the outer edge of the dust shield which may readily be removed and made available to the reader of the book as a book marker.

2. Description of the Prior Art

It has been customary to provide the more expensive books which are generally referred to as the "hard cover" or "hard back" books with colorful protective covers. In the use of such books when it is necessary to stop reading them it is necessary to find a piece of paper or something that can be inserted between the pages to mark the place where the reader should again start to read to continue the continuity of the book. There are apparently no instances available in the prior art where a book marker associated with the book is available in the book to enable a reader to quickly and accurately mark his place of reading in the book. It has long been known that it would be desirable to have a readily usable marker available so that a reader can easily mark the place in the book so that the story can quickly be located when the book is picked up again for reading.

SUMMARY OF THE INVENTION

It is therefore an object of this invention to provide a dust shield or protective cover having a perforated terminal tab at the end which can be readily extracted from the protective cover and used as a book marker whenever the necessity of a book marker becomes apparent. In the instance of the so-called "paper backs" or books that are sold at more reasonable prices, the outer edges of the soft back covers are perforated along their edges which are turned in to provide book marker segments that can be removed and used as book markers.

BRIEF DESCRIPTION OF THE DRAWINGS

FIG. 1 is a perspective view of a book with both covers open and a dust shield or protective cover over the sides of the book, and illustrating the perforated book markers which can be torn off and used as book markers.

FIG. 2 is a different perspective view of a so-called paper back book having the outer edges of the soft cover turned in and perforated to provide a removable book marker strip.

FIG. 3 is a view similar to FIG. 2 wherein the inturned edge of the soft copy or paper back is perforated along the outer edge and turned in to provide the book marker.

FIG. 4 is an inside plan view of the dust shield or protective cover embodying the invention.

DESCRIPTION OF THE PREFERRED EMBODIMENT

Referring now to FIG. 1, a book 10 is shown in a standing perspective position with the pages 12 of the book shown in a book closed relation. The book has hard backs 14, each having one of their edges secured in the binding 16 which holds one edge of the pages 12 of the book together so that the individual pages 12 can be turned one at a time to permit the reader to read the printing thereon and see the illustrations that are embodied on each of the pages 12 of the book 10.

Espressed in more detail, the pages 12 of the book 10 are united at one edge of the spine or binding 16 by means well known in the art of book binding, and which may encompass gluing, sewing, stapling, or other means.

A dust shield or protective cover 18 having a body section 20 as also illustrated in FIG. 4 is of sufficient length to cover the outside of the binding 16 and to wrap around both sides of the hard backs 14 and having in-turned flaps 22 and 24 adapted to be folded over the outer edges of the hard backs 14 to clamp the dust shield 18 in place on the book by having the outer in-turned flaps 22 and 24 clamped between the hard backs 14 and the pages 12 of the book on opposite sides of the book.

The outer edges of the inturned flaps 22 and 24 are scored with perforations 26 to provide narrow book marker strips 28 which may be separated from the inturned flaps 22 and 24 merely by tearing them along the perforations 26 to make the book marker strips 28 readily available for use as book markers.

In situations where it is desired to show the sales price of the book on the dust shield 20, a small tab 29 separated for example from the book marker strips 28 by perforations 31 may be provided to show the sales price of the book. It is contemplated that the tab 29 showing the sales price may be torn off in instances where the book is being given as a present.

FIG. 2 illustrates the invention as embodied in a paper back book wherein the covers are formed of somewhat heavier material than the pages of the book, and the outer edges of the cover 30 of the book are folded inwardly as shown at 32 and are provided with book marker strips 34 along the inner edge, and wherein perforations 36 are provided to render the book marker strips 34 readily removable therefrom.

In the embodiment of FIG. 3, the outer edge of the paper back cover 30 of the book is perforated as shown at 40 in alignment with the outer edge of the book, and the cover is turned in a short distance to provide a narrow book marker strip 42 which may readily be removed and used as a book marker when the occasion of need therefor arises.

I claim:

1. The combination with a book having a plurality of stacked pages and a binding securing one edge of the pages together as by gluing, sewing, etc., of covers overlying opposite sides of the stacked pages and secured in the binding, a dust shield overlying the binding and the covers and having inturned flaps, and perforations along the inner edges of one of the flaps to define a removable narrow book marker strip.

2. The invention defined in claim 1 wherein the book marker strip is associated with a terminal edge of the dust shield said shield having its terminal edges engaged between the covers and the plurality of pages of the book.

3. The invention defined in claim 2 wherein a second book marker strip is positioned along the other edge of the dust shield.

4. In a book of the paper back type having a plurality of pages, a binding securing the edges of the pages together, a paper back cover of heavier material than the pages of the book secured to the binding and overlying both sides of the plurality of pages, the outer edges of the paper back covers being turned inwardly, and perforations along the inturned portions of the cover whereby a narrow strip may be detached from each side of the inturned portions and used as a book marker.

5. The invention defined in claim 4 wherein the perforations are along the juncture of the paper back and the inturned portion thereof.

* * * * *